United States Patent [19]

Holton

[11] 4,012,280

[45] Mar. 15, 1977

[54] DELIGNIFICATION OF LIGNOCELLULOSIC MATERIAL WITH AN ALKALINE LIQUOR IN THE PRESENCE OF A CYCLIC KETO COMPOUND

[75] Inventor: Harry Hutchinson Holton, Beloeil, Canada

[73] Assignee: Canadian Industries, Ltd., Montreal, Canada

[22] Filed: Aug. 30, 1976

[21] Appl. No.: 718,980

[30] Foreign Application Priority Data

| | | |
|---|---|---|
| Sept. 5, 1975 | United Kingdom | 36636/75 |
| Sept. 5, 1975 | United Kingdom | 36637/75 |
| Sept. 5, 1975 | United Kingdom | 36638/75 |
| Sept. 5, 1975 | United Kingdom | 36639/75 |

[52] U.S. Cl. ..... 162/65; 8/111; 162/72; 162/82; 162/90

[51] Int. Cl.[2] ..... D21C 3/02; D21C 3/20; D21C 9/10

[58] Field of Search ..... 162/25, 65, 72, 82, 162/88, 89, 90, 60; 260/396 R, 351, 276, 250 BC, 310 B, 312, 365, 369, 108 R, 108 A, 109, 111, 156

[56] References Cited

UNITED STATES PATENTS 3,888,727 6/1975 Kenig ..... 162/65

*Primary Examiner*—Arthur L. Corbin
*Attorney, Agent, or Firm*—Guy Drouin

[57] ABSTRACT

Delignification of lignocellulosic material by treatment with an alkaline liquor in the presence of a cyclic keto compound such as anthraquinone.

11 Claims, No Drawings

DELIGNIFICATION OF LIGNOCELLULOSIC MATERIAL WITH AN ALKALINE LIQUOR IN THE PRESENCE OF A CYCLIC KETO COMPOUND

This invention relates to a process for the delignification of lignocellulosic material such as wood, straw, bagasse, etc.

The processing of lignocellulosic material to produce cellulose suitable for the manufacture of paper products involves the removal of lignin and other non-cellulosic components such as gums. Reagents that attack lignin without affecting appreciably the cellulose component are preferred for this purpose. In the sulphate or kraft process lignocellulosic material is cooked with a mixture of sodium hydroxide and sodium sulphide. In the soda process the cooking is carried out with sodium hydroxide alone. In Canadian Patent No. 895,756 issued on Mar. 21, 1972 to H. E. Worster and M. F. Pudek there is described a two stage soda-oxygen pulping process comprising a first stage sodium hydroxide digestion, followed by defiberization of the product of the sodium hydroxide digestion, and a second stage digestion with sodium hydroxide in the presence of excess oxygen. This process produces pulp in yield comparable to the yield of a conventional kraft process. Although these processes are effective in the removal of lignin from lignocellulosic material such as wood, the cellulose component of the material is attacked also to a certain degree, resulting in a lowering of yields and degradation of the product.

The contribution to air pollution of volatile mercaptans and hydrogen sulphide is a serious disadvantage of the kraft process. The soda process is superior in this respect; however, the soda process is unsuitable for pulping coniferous woods because of long cooking times and low yields. Even in the case of hardwoods, yields are usually inferior to those achieved using the kraft process. A recent publication (B. Bach and G. Fiehn, Zellstoff Papier 21, No. 1,3–7, January 1972) and a related East German Patent No. 98,549 of June 20, 1973 disclose the use of anthraquinone-2-monosulphonic acid (AMS) as a means of improving yields in the soda process. More recently, U.S. Pat. No. 3,888,727) this additive was employed in the first stage of a soda-oxygen process, resulting in yields superior to those of a conventional kraft process; the pulp possessed strength properties comparable to kraft. Unfortunately, the soda-AMS pulping process does not eliminate the odour problem, since sulphur derived from the additive is converted to sulphide in the pulping chemicals recovery systems and thence to mercaptans or hydrogen sulphide during the next cooking cycle. The economic advantages resulting from higher yields are largely offset by the relatively high cost of AMS. Other sulphur-free derivatives were tested by Bach and Fiehn (above recent publication) and were found to be substantially less effective than AMS.

It has now been found that lignocellulosic material can be delignified in high yield by a process which comprises a digestion with an alkaline pulping liquor in the presence of a cyclic keto compound selected from the group consisting of naphthoquinone, anthraquinone, anthrone, phenanthrenequinone, the alkyl, alkoxy and amino derivatives of said quinones, 6,11-dioxo-1H-anthra[1,2-c]pyrazole, anthraquinone-1,2-naphthacridone, 7,12-dioxo-7,12-dihydroanthra[1,2-b]pyrazine, 1,2-benzanthraquinone and 10-methylene anthrone.

Optionally the digestion with alkaline pulping liquor may be followed by a second stage digestion in alkaline medium with oxygen or an oxygen-containing gas under pressure. The novel process provides a pulp in higher yield at an increased rate of delignification in comparison to similar processes without additive. In addition, the cyclic keto additives proposed in this invention are free of sulphur and hence have the marked advantage over the anthraquinone monosulphonic acid proposed in East German Patent No. 98,549 of producing no polluting sulphur compounds. Furthermore, the concentrations of the cyclic keto additives required are at an economically advantageous level and often are less than that required with the known anthraquinone monosulphonic acid.

Thus the main object of the invention is to provide a pulping process which gives an increased yield of cellulosic pulp. Another object is to provide a pulping process having an increased rate of delignification, thus permitting a lower energy consumption and a higher throughput. A further object is to provide a pulping process which has a lower pollution potential. Additional objects will appear hereinafter.

The process of this invention comprises the steps of 1. treating lignocellulosic material in a closed reaction vessel with an alkaline pulping liquor containing from 0.001% to 10.0% by weight, based on the lignocellulosic material, of a cyclic keto compound selected from the group consisting of naphthoquinone, anthraquinone, anthrone, phenanthrenequinone, the alkyl, alkoxy and amino derivatives of said quinones, 6,11-dioxo-1H-anthra[1,2-c]pyrazole, anthraquinone-1,2-naphthacridone, 7,12-dioxo-7,12-dihydroanthra[1,2-b]pyrazine, 1,2-benzanthraquinone and 10-methylene anthrone, the treatment taking place at a maximum temperature in the range of 150° C. to 200° C. for a period of 0.5 to 480 minutes, and 2. displacing the pulping liquor from the lignocellulosic material with water or an aqueous liquor inert to the lignocellulosic material to obtain a delignified cellulosic material.

The delignified cellulosic material produced by the above two steps may be used without further treatment or may be subjected to conventional bleaching steps.

The delignified cellulosic material may be subjected to the following additional treatment steps: 3. treatment of the delignified cellulosic material in aqueous suspension at a consistency of 2% to 40% by weight for 0.5 to 60 minutes at 20° C. to 90° C. with 2% to 20% by weight of an alkali metal base, and 4. treatment of the alkaline material in aqueous medium at a consistency of from 3.0% to 40% by weight with oxygen or an oxygen-containing gas for 0.5 to 120 minutes at a temperature of 80° C. to 150° C. and a partial pressure of oxygen of 20 to 200 pounds per square inch.

When the lignocellulosic material employed is wood, it is first converted into the form of chips. This step is not required when the lignocellulosic material is of fibrous form.

The lignocellulosic material may be refined between steps (1) and (2) or between steps (2) and (3). Refining can be carried out with known equipment such as a single disc or double disc refiner.

The process of this invention can be used to delignify either coniferous or deciduous species of wood. By coniferous is meant species such as pine, spruce and balsam fir. By deciduous is meant species such as birch, aspen, eastern cottonwood, maple, beech and oak. When treating a high density deciduous wood such as birch, it is preferable to employ a longer time to reach maximum cooking temperature in the first step and to add an alkali base in the optional third step while the pulp is at a low consistency, e.g. 2% to 6%.

For the reasons given above, the alkaline pulping liquor ideally suitable for use in the first step of the process of the invention is the soda liquor. However, other conventional alkaline pulping liquors can be used, e.g. the kraft or polysulphide liquor, in which case environmental effects are still present but, due to the presence of the additives of the invention, the pulping action is accelerated and yields are increased.

The soda liquor contains from 8% to 20% by weight of alkali metal base expressed as percent effective alkali, based on the weight of the lignocellulosic material, and normally also contains alkali metal carbonate. Digestion with this liquor in the presence of the cyclic keto compounds according to the invention results in certain cases, in the cooking time being lessened by a factor of four.

The kraft or sulphate liquor contains from 8% to 15% by weight of alkali metal base expressed as percent effective alkali (TAPPI T-1203 S-6) and from 5% to 40% by weight of alkali metal sulphide expressed as percent sulphidity (TAPPI T-1203 OS-61), based on lignocellulosic material. This pulping liquor will normally contain alkali metal sulphate and alkali metal carbonate. The pulping liquor may contain excess sulphur, i.e., polysulphides. The presence of polysulphides results in an improved yield and an amount of 1.0% to 5.0%, preferably 2.0% thereof (expressed as sulphur and based on weight of lignocellulosic material) in the liquor is therefore a definite advantage.

Effective alkali is the sum of all alkali hydroxide in solution expressed as $Na_2O$ including that formed by hydrolysis of the alkali sulphide, also expressed as $Na_2O$.

Sulphidity is the total sulphide, expressed as $Na_2O$, calculated as a percentage of total titratable alkali, including that formed by hydrolysis of the sulphide, also expressed as $Na_2O$.

Since the first step treatment of the process is carried out in a closed reaction vessel at a temperature in the range of from 150° C. to 200° C. in the presence of water, the reaction will take place under supra atmospheric pressure.

As mentioned above, the compounds which are suitable for use as additives in the process of the invention are the cyclic ketones selected from the group consisting of naphthoquinone, anthraquinone, anthrone and phenanthrenequinone, the alkyl, alkoxy and amino derivatives of these quinones, 6,11-dioxo-1H-anthra[1,2-c]pyrazole, anthraquinone-1,2-naphthacridone, 7,12-dioxo-7,12-dihydroanthra[1,2-b]pyrazine, 1,2-benzanthraquinone and 10-methylene anthrone. Among the alkyl derivatives which may be mentioned are any of the above quinones substituted with one or two alkyl groups containing from 1 to 4, preferably 1 to 2, carbon atoms. Among the alkoxy derivatives which are suitable for use as additives are any of the above quinones which are substituted with at least one alkoxy group having 1 to 4, preferably one, carbon atoms. Preferred among the above additives are anthrone, anthraquinone and the derivatives of anthraquinone. Most preferred because they can be easily and economically prepared and are particularly efficient are 1-methyl anthraquinone, 2-methyl anthraquinone, 2-ethyl anthraquinone, 2,6-dimethyl anthraquinone, 2,7-dimethyl anthraquinone, 2,3-dimethyl anthraquinone, 1-methoxy anthraquinone and 2-amino anthraquinone. The additive is employed in proportions of from 0.001% to 10.0%, preferably 0.01% to 1.0%, by weight based on the cellulosic material.

After the first step treatment with pulping liquor the resulting pulp yield will be about 40% to about 70%, by weight, based on the lignocellulosic material. The kappa number of the material at completion of the first step will lie in the range 10 to 150 for coniferous woods and in the range 5 to 100 for deciduous woods.

The partially delignified material resulting from the first treatment step is discharged from the pulping vessel and the spent liquor displaced by fresh water or optionally by an aqueous liquor inert to lignocellulosic material such as the spent liquor from the alkaline oxygen treatment step or "white water" from a later stage of a papermaking process.

Optionally, the delignified cellulosic material may then be subjected to an alkaline oxygen treatment. To the material is added alkali metal base. The alkali metal base may be provided in the form of pulping liquor such as used in the first step of the process. This liquor, depending upon whether it is a soda liquor or a kraft liquor, may therefore contain carbonate or sulphide, sulphate and carbonate in addition to alkali metal base. Where the pulping liquor is a kraft liquor, it may be of advantage to oxidize the liquor by aeration with an oxygen-containing gas prior to its addition to the delignified cellulosic material. Preferably there is also added from 0.1% to 1.0% by weight of the pulp of a magnesium salt such as magnesium chloride or magnesium sulphate calculated as magnesium ion. The magnesium salt may be added directly as the salt or as a complex formed with the spent liquor from the alkaline oxygen treatment step.

The alkaline treated material is then fed into an oxygen treatment vessel. The material is there treated with oxygen or an oxygen-containing gas under a partial pressure of oxygen of from 20 to 200 pounds per square inch. The product of the oxygen treatment is separated from the spent liquor and washed with water. It will have a residual lignin content of from 1% to 6%, preferably from 1.5% to 4.5% of the weight of the original cellulosic material corresponding to a yield of from 80% to 98% by weight of the pulp entering the oxygen treatment.

The alkali metal base employed as reagent in the process of this invention may be sodium hydroxide, potassium hydroxide, sodium carbonate or potassium carbonate. The alkali metal sulphide may be sodium sulphide or potassium sulphide.

The material resulting from step (2) may be bleached by any conventional bleaching process. A conventional sequence comprising chlorination, alkaline extraction, chlorine dioxide treatment, alkaline extraction, chlorine dioxide treatment (C-E-D-E-D) when applied to the material resulting from step (2), will provide a product having a brightness of approximately 85–90 units (Elrepho). The material resulting from step (4) may be bleached by the sequence chlorination, alkaline extraction, chlorine dioxide treatment (C-E-D) or any other conventional sequence. When applied to the material resulting from step (4), the sequence C-E-D will provide a product having a brightness of approximately 85–90 units (Elrepho).

The process of this invention has the advantage that the additives are effective at concentrations that are economically favourable and that is also requires a lower amount of pulping chemicals. The process also provides a pulp in higher yield at an increased rate of delignification, thus permitting lower raw material cost, lower energy consumption and higher throughput. Another advantage of the process is that it results in lessened pollution potential as compared with the process of East German Patent No. 98,549. This latter advantage is only significant if soda pulping is used as against kraft or polysulphide pulping.

Still another advantage of the present invention over the process described in said East German patent is that, for a given concentration and under comparable pulping conditions, the present additives and especially the alkyl derivatives are more effective than AMS.

The invention is illustrated by the following Examples but its scope is not limited to the embodiments shown therein.

In the Examples the brightness, kappa number, permanganate number and viscosity determination were carried out by the following methods.

| | |
|---|---|
| Brightness | CPPA Method E.1 |
| Kappa number | TAPPI Method T-236 M-60 |
| Permanganate number | TAPPI Method T-214 M-50 using 25 ml. of 0.1N $KMnO_4$ |
| Viscosity | TAPPI Method T-230 SU-66 |

In all the following Examples, pulping was carried out in stainless steel pressure vessels of either one of the following two types; (1) a set of three such vessels each containing a rotatable horizontal basket, and (2) an assembly of eight such vessels (hereinafter called the microdigester assembly) each of which is itself horizontally rotatable. Large size samples of chips of 300, 600 or 2,400 grams (oven dried weight) were pulped in any one of the three vessels of the first type while small size samples of 75 grams were pulped eight at a time in the second type of vessels, i.e., in the microdigester assembly. The chips were dried to approximately 90% consistency, divided into appropriate portions in consideration of the number and size of the pulping runs to be carried out and stored at 4° C. Exact amounts of chips of accurately known consistency were weighed out and soaked 24 hours in water prior to pulping. Soaked chips were placed inside the pressure vessel and optionally pre-steamed for 10 minutes. Pulping liquor and dilution water were then added in the amounts required to give the desired effective alkali and to obtain a liquor to wood ratio of 4:1. Indirect electrical heating was used in both types of vessels. In the case of the microdigester assembly water under pressure was employed as a heat transfer medium. Heating was controlled to linearly raise the temperature to a preset maximum in a given time and to maintain it within ± 2° C. of said maximum to the end of the cooking period.

After completion of the cooking, the pressure was released and the pulp together with the used cooking liquor was transferred to a mixer such as a Cowles dissolver, diluted to 2% consistency and stirred for 5 minutes to simulate the blow down of pulp that occurs in commercial scale digesters. The pulp was then washed twice by dilution to 2% consistency with water and filtered and pressed to 25% consistency. The pulp was then crumbed in a Hobart mixer, weighed and samples were taken for yield, kappa number and viscosity measurements.

EXAMPLE 1

43 samples of chips from a variety of wood species were subjected to pulping treatment employing soda pulping liquor containing cyclic keto compounds according to the invention as additives, or soda pulping liquor without additive. Cooking with pulping liquor was carried out using the digester and procedure described immediately above. The characteristics of the 43 pulping runs and the results obtained are shown in Table I.

TABLE I

| | Additive | | | SODA PULPING Pulping Conditions | | | | Results without Additive | | | Results with Additive | | |
|---|---|---|---|---|---|---|---|---|---|---|---|---|---|
| Run No. | Name | % on wood | Wood species | Eff. Alkali % | max. temp. ° C. | Time to temp. Min. | Time at temp. Min. | Kappa No. | Yield % | Viscosity cps. | Kappa No. | Yield % | Viscosity cps. |
| 1 | ANTHRAQUINONE | 1.0 | S.B.P. | 15.5 | 180 | 60 | 50 | 105 | 55.3 | — | 27.5 | 51.1 | — |
| 2 | 1-METHYLANTHRAQUINONE | 0.25 | B.S. | 15.5 | 170 | 90 | 80 | 90.0 | 53.2 | — | 36.0 | 49.9 | 20.6 |
| 3 | 2-METHYLANTHRAQUINONE | 1.0 | S.B.P. | 15.5 | 180 | 60 | 50 | 105.0 | 55.3 | — | 25.8 | 50.8 | — |
| 4 | 2-ETHYLANTHRAQUINONE | 1.0 | S.B.P. | 15.5 | 180 | 60 | 50 | 105.0 | 55.3 | — | 26.3 | 50.4 | — |
| 5 | 2-t-BUTYLANTHRAQUINONE | 1.0 | S.B.P. | 15.5 | 180 | 60 | 50 | 105.0 | 55.3 | — | 34.0 | 50.6 | — |
| 6 | 2,6-DIMETHYLANTHRAQUINONE | 0.25 | B.S. | 17.8 | 170 | 90 | 92 | 75.0 | 50.3 | — | 33.8 | 48.2 | 16.0 |
| 7 | 2,7-DIMETHYLANTHRAQUINONE | 0.25 | B.S. | 17.8 | 170 | 90 | 92 | 75.0 | 50.3 | — | 24.6 | 48.0 | 16.4 |
| 8 | ANTHRONE | 1.0 | B.S. | 15.5 | 170 | 90 | 80 | 90.0 | 53.2 | — | 33.1 | 52.8 | 20.0 |
| 9 | PHENANTHRENEQUINONE | 1.0 | S.B.P. | 15.5 | 180 | 60 | 50 | 105.0 | 55.3 | — | 56.3 | 51.2 | — |
| 10 | 1,4-NAPHTHOQUINONE | 1.0 | S.B.P. | 15.5 | 180 | 60 | 50 | 105 | 55.3 | — | 67.0 | 52.5 | — |
| 11 | 6,11-DIOXO-1H-ANTHRA [1,2-c]PYRAZOLE | 1.0 | B.S. | 15.5 | 170 | 90 | 80 | 108.8 | 55.9 | — | 33.7 | 51.3 | 22.5 |
| 12 | ANTHRAQUINONE-1,2-NAPHTHACRIDONE | 1.0 | B.S. | 15.5 | 170 | 90 | 80 | 109.2 | 56.6 | — | 38.2 | 52.7 | 25.6 |
| 13 | 7,12-DIOXO-7,12-DIHYDROANTHRA [1,2-b]PYRAZINE | 1.0 | B.S. | 15.5 | 170 | 90 | 80 | 109.2 | 56.6 | — | 34.4 | 51.6 | 25.6 |
| 14 | ANTHRAQUINONE | 0.25 | B.S. | 17.8 | 170 | 90 | 92 | 89.2 | 52.5 | — | 27.4 | 48.4 | 20.2 |
| 15 | 1,2-BENZANTHRAQUINONE | 0.25 | B.S. | 15.5 | 170 | 90 | 80 | 105.2 | 56.4 | — | 54.1 | 51.7 | — |
| 16 | 1,2-BENZANTHRAQUINONE | 1.0 | B.S. | 15.5 | 170 | 90 | 80 | 109.2 | 56.6 | — | 34.4 | 51.6 | 25.6 |
| 17 | 2-AMINOANTHRA- | 1.0 | B.S. | 15.5 | 170 | 90 | 80 | 75.5 | 52.5 | — | 22.2 | 49.4 | — |

TABLE I-continued

| Run No. | Additive Name | % on wood | Wood species | SODA PULPING Pulping Conditions Eff. Alkali % | max. temp. °C. | Time to temp. Min. | Time at temp. Min. | Results without Additive Kappa No. | Yield % | Viscosity cps. | Results with Additive Kappa No. | Yield % | Viscosity cps. |
|---|---|---|---|---|---|---|---|---|---|---|---|---|---|
| | QUINONE | | | | | | | | | | | | |
| 18 | 2-METHYLNAPHTHO-QUINONE | 1.0 | S.B.P. | 15.5 | 180 | 60 | 50 | 105.0 | 55.3 | — | 72.8 | 53.2 | — |
| 19 | 1-METHOXYANTHRA-QUINONE | 1.0 | S.B.P. | 15.5 | 180 | 60 | 50 | 105.0 | 55.3 | — | 42.1 | 52.6 | — |
| 20 | 2-METHYLANTHRA-QUINONE | 0.03 | B.S. | 17.8 | 170 | 90 | 85 | 71.1 | 51.1 | — | 38.5 | 51.8 | — |
| 21 | 2-METHYLANTHRA-QUINONE | 0.06 | B.S. | 17.8 | 170 | 90 | 85 | 71.1 | 51.1 | — | 33.1 | 53.7 | — |
| 22 | 2-METHYL ANTHRA-QUINONE | 0.13 | B.S. | 17.8 | 170 | 90 | 85 | 71.1 | 51.1 | — | 27.1 | 48.9 | — |
| 23 | ANTHRAQUINONE | 0.06 | M.H. | 15.5 | 165 | 105 | 150 | 30.6 | 52.1 | 32.0 | 18.1 | 50.2 | 20.1 |
| 24 | ANTHRAQUINONE | 0.06 | T.A. | 14.0 | 170 | 90 | 60 | 28.4 | 58.1 | 27.7 | 15.3 | 58.6 | 21.7 |
| 25 | 1,4-DIMETHOXY-ANTHRAQUINONE | 0.25 | B.S. | 15.5 | 170 | 90 | 80 | 115.1 | 56.1 | — | 69.7 | 53.6 | — |
| 26 | 1,5-DIMETHOXY-ANTHRAQUINONE | 0.25 | B.S. | 15.5 | 170 | 90 | 80 | 115.1 | 56.1 | — | 73.7 | 52.8 | — |
| 27 | 1,8-DIMETHOXY-ANTHRAQUINONE | 0.25 | B.S. | 15.5 | 170 | 90 | 80 | 102.7 | 59.8 | — | 77.6 | 56.7 | — |
| 28 | 2,3-DIMETHYLANTHRA-QUINONE | 0.25 | B.S. | 15.5 | 170 | 90 | 80 | 121.7 | 61.0 | — | 40.5 | 51.6 | — |
| 29 | ANTHRAQUINONE | 0.01 | M.H. | 15.5 | 165 | 120 | 150 | 28.3 | 51.1 | 26.7 | 20.7 | 51.1 | 27.8 |
| 30 | ANTHRAQUINONE | 0.04 | M.H. | 15.5 | 165 | 120 | 150 | 28.3 | 51.1 | 26.7 | 17.8 | 50.8 | 27.4 |
| 31 | ANTHRAQUINONE | 0.16 | M.H. | 15.5 | 165 | 120 | 150 | 28.3 | 51.1 | 26.7 | 15.1 | 51.5 | 23.1 |
| 32 | ANTHRAQUINONE | 0.06 | M.H. | 15.5 | 165 | 105 | 150 | 30.6 | 52.1 | 32.0 | 18.1 | 50.2 | 20.1 |
| 33 | ANTHRAQUINONE | 0.06 | M.H. | 17.0 | 165 | 105 | 150 | 21.1 | 49.8 | 27.0 | 22.1 | 53.1 | 22.7 |
| 34 | ANTHRAQUINONE | 0.06 | M.H. | 18.6 | 165 | 105 | 150 | 17.3 | 48.7 | 26.9 | 14.6 | 50.5 | 18.4 |
| 35 | 1,4-DIMETHYLANTHRA-QUINONE | 0.25 | B.S. | 15.5 | 170 | 90 | 80 | 85.7 | 56.3 | — | 39.9 | 51.0 | 23.7 |
| 36 | 1,3-DIMETHYLANTHRA-QUINONE | 0.25 | B.S. | 15.5 | 170 | 90 | 80 | 85.7 | 56.3 | — | 36.0 | 50.8 | 24.8 |
| 37 | 1,2,4-TRIMETHOXY-ANTHRAQUINONE | 0.25 | B.S. | 15.5 | 170 | 90 | 80 | 90.7 | 58.0 | — | 74.0 | 55.6 | — |
| 38 | 2-ISOPROPYLANTHRA-QUINONE | 0.25 | B.S. | 15.5 | 170 | 90 | 80 | 90.7 | 58.0 | — | 63.4 | 53.4 | — |
| 39 | 2,3,6,7-TETRAMETHYL-ANTHRAQUINONE | 0.25 | B.S. | 15.5 | 170 | 90 | 80 | 89.4 | 59.4 | — | 72.7 | 55.6 | — |
| 40 | 10-METHYLENE ANTHRONE | 1.00 | B.S. | 15.5 | 170 | 90 | 80 | 121.6 | 57.5 | — | 47.8 | 52.1 | 22.8 |
| 41 | 1-METHYLAMINOAN-TRA-QUINONE | 1.00 | B.S. | 15.5 | 170 | 90 | 80 | 121.6 | 57.5 | — | 42.2 | 52.1 | 23.9 |
| 42 | 1,5-DIAMINOANTHRA-QUINONE | 1.00 | B.S. | 15.5 | 170 | 90 | 80 | 98.5 | 60.4 | — | 45.1 | 52.5 | — |
| 43 | 2,6-DIAMINOANTHRA-QUINONE | 1.00 | B.S. | 15.5 | 170 | 90 | 80 | 98.5 | 60.4 | — | 50.2 | 54.0 | — |

Wood species:
S.B.P. = Spruce, Balsam, Pine
B.S. = Black Spruce
M. H. = Mixed Hardwoods
T. A. = Trembling Aspen

EXAMPLE 1*a*

Eight samples of black spruce chips were subjected to pulping treatment employing soda pulping liquor containing cyclic keto compounds according to the invention as additives, or anthraquinone-2-mono sulfonic acid sodium salt as an additive, or soda pulping liquor without additive. Cooking was carried out using the same digesters and procedure as in Example 1. The characteristics of the 8 pulping runs and the results obtained are shown in Table 1*a*.

TABLE Ia

| Run No. | Additive Name | % on Wood | SODA PULPING Pulping Conditions Eff. Alkali % | Max. temp. °C. | Time to temp. Min. | Time at temp. Min. | Results without Additive Kappa No. | Yield % | Results with Additive Kappa No. | Yield % |
|---|---|---|---|---|---|---|---|---|---|---|
| 1 | ANTHRAQUINONE | 0.01 | 15.5 | 170 | 90 | 80 | 115.1 | 56.1 | 83.7 | 54.5 |
| 2 | 2-METHYLANTHRA-QUINONE | 0.01 | 15.5 | 170 | 90 | 80 | 115.1 | 56.1 | 77.3 | 54.1 |
| 3 | ANTHRAQUINONE-2-SULFONIC ACID SODIUM SALT | 0.02 | 15.5 | 170 | 90 | 80 | 115.1 | 56.1 | 108.9 | 56.2 |
| 4 | ANTHRAQUINONE | 0.02 | 15.5 | 170 | 90 | 80 | 115.1 | 56.1 | 74.0 | 53.3 |
| 5 | 2-METHYLANTHRA-QUINONE | 0.02 | 15.5 | 170 | 90 | 80 | 115.1 | 56.1 | 59.8 | 52.9 |
| 6 | ANTHRAQUINONE-2-SULFONIC ACID SODIUM SALT | 0.05 | 15.5 | 170 | 90 | 80 | 115.1 | 56.1 | 84.8 | 55.5 |
| 7 | ANTRHAQUINONE | 0.05 | 15.5 | 170 | 90 | 80 | 115.1 | 56.1 | 59.8 | 52.9 |
| 8 | 2-METHYLANTHRA- | | | | | | | | | |

TABLE Ia-continued

| Run No. | Additive Name | % on Wood | SODA PULPING Pulping Conditions: Eff. Alkali % | Max. temp. °C. | Time to temp. Min. | Time at temp. Min. | Results without Additive: Kappa No. | Yield % | Results with Additive: Kappa No. | Yield % |
|---|---|---|---|---|---|---|---|---|---|---|
| | QUINONE | 0.05 | 15.5 | 170 | 90 | 80 | 115.1 | 56.1 | 53.4 | 52.3 |

Wood Species: Black Spruce

EXAMPLE 2

21 samples of chips from a variety of wood species were subjected to pulping treatment employing kraft (sulphate) pulping liquor containing cyclic keto compounds according to the invention as additives, or kraft pulping liquor without additive. Cooking was carried out using the same digester and procedure as in Example 1. The characteristics of the 21 pulping runs and the results obtained are shown in Table II. The sulfidity and maximum temperature were the same in all the runs at 25% and 170° C. respectively.

EXAMPLE 3

18 samples of chips from a variety of wood species were subjected to pulping treatment employing polysulphide pulping liquor containing cyclic keto compounds according to the invention as additives, or polysulphide pulping liquor without additive. Cooking was carried out using the same digester and procedure as in Example 1. The characteristics of the 18 pulping runs and the results obtained are shown in Table III. In all the runs the polysulphide liquor was an ordinary kraft liquor with sulphur added thereto in the amount of 2% by weight based on wood; the sulphidity was 25% and the maximum cooking temperature was 170° C.

TABLE II

| Run No. | Additive Name | % on wood | KRAFT PULPING Pulping Conditions: Wood species | Time to temp. Min. | Time at temp. Min. | Results without Additive: Eff. Alkali % | Kappa No. | Yield % | Viscosity cps | Results with Additive: Eff. Alkali % | Kappa No. | Yield % | Viscosity cps |
|---|---|---|---|---|---|---|---|---|---|---|---|---|---|
| 1 | 1-METHYLANTHRAQUINONE | 0.13 | B.S. | 90 | 100 | 13.0 | 43.9 | 50.7 | — | 13.0 | 36.6 | 49.9 | 37.0 |
| 2 | 2-METHYLANTHRAQUINONE | 0.13 | B.S. | 90 | 100 | 13.0 | 46.3 | 53.3 | — | 13.0 | 28.9 | 52.8 | 41.6 |
| 3 | 2-METHYLANTHRAQUINONE | 1.0 | S.B.P. | 60 | 84 | 12.0 | 88.2 | 57.4 | — | 12.0 | 42.3 | 55.6 | — |
| 4 | 2-ETHYLANTHRAQUINONE | 1.0 | S.B.P. | 60 | 84 | 12.0 | 88.2 | 57.4 | — | 12.0 | 46.7 | 55.2 | — |
| 5 | 2-t-BUTYLANTHRAQUINONE | 1.0 | S.B.P. | 60 | 84 | 12.0 | 88.2 | 57.4 | — | 12.0 | 54.0 | 54.8 | — |
| 6 | 2,6-DIMETHYLANTHRAQUINONE | 0.13 | B.S. | 90 | 100 | 13.0 | 39.8 | 50.5 | 47.0 | 13.0 | 36.9 | 50.8 | 47.2 |
| 7 | ANTHRAQUINONE | 1.0 | S.B.P. | 60 | 84 | 12.0 | 88.2 | 57.4 | — | 12.0 | 47.0 | 54.7 | — |
| 8 | ANTHRONE | 1.0 | S.B.P. | 60 | 84 | 12.0 | 88.2 | 57.4 | — | 12.0 | 63.1 | 54.5 | — |
| 9 | 6,11-DIOXO-1H-ANTHRA [1,2-c]PYRAZOLE | 0.13 | B.S. | 90 | 100 | 13.0 | 39.8 | 50.5 | 47.0 | 13.0 | 36.5 | 50.1 | 41.9 |
| 10 | ANTHRAQUINONE-1,2-NAPHTHACRIDONE | 0.13 | B.S. | 90 | 100 | 13.0 | 43.9 | 50.9 | — | 13.0 | 43.6 | 51.6 | — |
| 11 | 1,2-BENZANTHRAQUINONE | 0.13 | B.S. | 90 | 100 | 13.0 | 43.9 | 50.9 | — | 13.0 | 38.8 | 50.7 | 49.2 |
| 12 | 7,12-DIOXO-7,12-DIHYDROANTHRA [1,2-b] PYRAZINE | 0.13 | B.S. | 90 | 100 | 13.0 | 43.9 | 50.9 | — | 13.0 | 38.1 | 50.7 | 45.5 |
| 13 | 2-AMINOANTHRAQUINONE | 1.0 | B.S. | 90 | 100 | 13.0 | 43.9 | 50.9 | — | 13.0 | 36.7 | 50.7 | — |
| 14 | 1-METHOXYANTHRAQUINONE | 1.0 | S.B.P. | 60 | 84 | 12.0 | 88.2 | 57.4 | — | 12.0 | 50.0 | 54.8 | — |
| 15 | 1,4-DIMETHOXYANTHRAQUINONE | 0.5 | B.S. | 90 | 80 | 14.0 | 31.7 | 50.3 | 40.4 | 14.0 | 28.9 | 50.9 | 37.8 |
| 16 | 2,3-DIMETHYLANTHRAQUINONE | 0.25 | B.S. | 90 | 80 | 14.0 | 34.2 | 50.3 | 37.8 | 14.0 | 20.0 | 49.9 | 30.7 |
| 17 | 1,4-DIMETHYLANTHRAQUINONE | 0.25 | B.S. | 90 | 80 | 14.0 | 34.2 | 50.3 | 37.8 | 14.0 | 29.2 | 51.6 | 38.8 |
| 18 | 1,3-DIMETHYLANTHRAQUINONE | 0.25 | B.S. | 90 | 80 | 14.0 | 34.2 | 50.3 | 37.8 | 14.0 | 27.8 | 49.9 | 37.8 |
| 19 | PHENANTHRENEQUINONE | 2.00 | B.S. | 90 | 80 | 14.0 | 37.4 | 51.3 | 40.4 | 14.0 | 33.1 | 53.6 | 38.5 |
| 20 | 1,5-DIMETHOXYANTHRAQUINONE | 1.5 | B.S. | 90 | 80 | 14.0 | 35.6 | 49.7 | 38.0 | 14.0 | 33.4 | 50.7 | 33.5 |
| 21 | 2-ISOPROPYLANTHRAQUINONE | 0.25 | B.S. | 90 | 80 | 14.0 | 31.5 | 50.3 | 37.8 | 14.0 | 25.5 | 49.5 | 35.1 |

Wood species:
B.S. = Black Spruce
S.B.P. = Spruce, Aspen, Pine

TABLE III

POLYSULFIDE PULPING WITH ADDITIVES

| Run No. | Additive Name | % on wood | Pulping Conditions Wood species | Time to temp. Min. | Time at temp. Min. | Results without Additive Eff. alkali % | Kappa No. | Yield % | TAPPI Viscosity cps | Results with Additive Eff. alkali % | Kappa No. | Yield % | TAPPI Viscosity cps |
|---|---|---|---|---|---|---|---|---|---|---|---|---|---|
| 1 | 2-METHYLANTHRAQUINONE | 0.25 | B.S. | 90 | 80 | 14.0 | 50.1 | 55.1 | — | 13.0 | 47.1 | 56.9 | — |
| 2 | 2-ETHYLANTHRAQUINONE | 0.25 | B.S. | 90 | 80 | 14.0 | 50.1 | 55.1 | — | 13.0 | 45.2 | 56.3 | — |
| 3 | 2-t-BUTYLANTHRAQUINONE | 0.25 | B.S. | 90 | 80 | 14.0 | 37.5 | 53.8 | 46.6 | 14.0 | 32.3 | 54.1 | 46.1 |
| 4 | 1-METHYLANTHRAQUINONE | 0.25 | B.S. | 90 | 80 | 14.0 | 37.5 | 53.8 | 46.6 | 14.0 | 32.8 | 53.6 | 46.8 |
| 5 | 2-AMINOANTHRAQUINONE | 1.00 | B.S. | 90 | 100 | 15.0 | 26.9 | 51.0 | 46.7 | 15.0 | 22.9 | 52.0 | 36.7 |
| 6 | 1-METHOXYANTHRAQUINONE | 0.50 | B.S. | 90 | 85 | 14.0 | 41.7 | 54.0 | — | 13.0 | 41.3 | 55.7 | 44.1 |
| 7 | 6,11-DIOXO-1H-ANTHRA[1,2-c]PYRAZOLE | 0.25 | B.S. | 90 | 80 | 14.0 | 37.5 | 53.8 | 46.6 | 14.0 | 34.2 | 54.2 | 48.1 |
| 8 | 2,6-DIMETYLANTHRAQUINONE | 0.25 | B.S. | 90 | 80 | 14.0 | 37.5 | 53.8 | 46.6 | 14.0 | 35.5 | 54.4 | 47.7 |
| 9 | PHENANTHRENEQUINONE | 0.25 | B.S. | 90 | 80 | 14.0 | 37.5 | 53.8 | 46.6 | 14.0 | 36.3 | 55.3 | 48.4 |
| 10 | ANTHRAQUINONE | 0.13 | S.B.P. | 60 | 120 | 15.5 | 33.7 | 51.5 | — | 15.5 | 26.2 | 51.4 | — |
| 11 | 1,2-BENZANTHRAQUINONE | 1.00 | B.S. | 90 | 80 | 14.0 | 43.0 | 53.4 | 47.4 | 14.0 | 31.1 | 54.3 | 42.9 |
| 12 | 7,12-DIOXO-7,12-DIHYDROANTHRA[1,2-b]PYRAZINE | 0.89 | B.S. | 90 | 80 | 14.0 | 43.0 | 53.4 | 47.4 | 14.0 | 29.9 | 54.6 | 41.8 |
| 13 | ANTHRAQUINONE | 0.13 | S.B.P. | 60 | 120 | 15.5 | 33.7 | 51.5 | — | 15.5 | 26.2 | 51.4 | — |
| 14 | 1,4-DIMETHOXYANTHRAQUINONE | 0.5 | B.S. | 90 | 80 | 14.0 | 33.7 | 52.1 | 50.3 | 14.0 | 30.3 | 53.5 | 48.8 |
| 15 | 1,5-DIMETHOXYANTHRAQUINONE | 0.5 | B.S. | 90 | 80 | 14.0 | 33.7 | 52.1 | 50.3 | 14.0 | 30.3 | 54.1 | 53.0 |
| 16 | 1,8-DIMETHOXYANTHRAQUINONE | 1.00 | B.S. | 90 | 80 | 14.0 | 43.0 | 53.4 | 47.4 | 14.0 | 37.7 | 54.8 | 47.3 |
| 17 | 2,3-DIMETHYLANTHRAQUINONE | 1.0 | B.S. | 90 | 80 | 14.0 | 43.0 | 53.4 | 47.4 | 14.0 | 31.7 | 53.8 | 36.9 |
| 18 | 1,3-DIMETHYLANTHRAQUINONE | 0.25 | B.S. | 90 | 80 | 14.0 | 38.0 | 53.2 | 51.6 | 14.0 | 34.6 | 54.3 | 48.6 |

Wood Species:
S.B.P. = Spruce, Balsam, Pine
B.S. = Black Spruce

EXAMPLE 4

9 samples of chips from a variety of wood species were subjected to pulping treatment using the same digester and procedure as in Example 1. In runs 1 and 2 the pulping liquor was a soda liquor while in runs 3 to 6 it was a kraft liquor and in runs 7 to 9 it was a polysulphide liquor with 2% added sulphur. Cyclic keto compounds in accordance with the invention were present in the pulping liquors of runs 1, 2, 4, 6, 8, and 9 but not in those of runs 3, 5 and 7. The characteristics of the 9 pulping runs are shown in Table IV.

The cellulosic pulp resulting from each of the 9 runs were then subjected to a conventional bleaching sequence C-E-D-E-D in which C means chlorine, E means caustic extraction and D means chlorine dioxide. The details of the bleaching are given in Table V. The physical properties of breaking length, burst factor, tear factor, bulk and elongation were then measured in all the runs. The details of these measurements are also given in Table VI. It can be seen that the runs employing additives of the present invention have equivalent and in some cases better strength properties than those without additives.

The physical properties of the pulps were determined on material processed by a P.F.I. mill to freeness levels of 300 and 500 Canadian Standard Freeness (C.S.F.). Handsheets were prepared in accordance with TAPPI Method T-220-M-60. The physical properties were determined by the following methods:

| | |
|---|---|
| Breaking length | TAPPI T-220 M-60 |
| Burst factor | TAPPI T-220 M-60 |
| Tear factor | TAPPI T-200 M-60 |
| Bulk | TAPPI T-220 M60 |
| Elongation | TAPPI T-220 M-60 |

TABLE IV

EFFECT OF ADDITIVES ON THE BLEACHING AND STRENGTH PROPERTIES OF ALKALINE PULPS - PULPING DATA

| Run No. | Pulp Type | Additive | % on wood | Wood species | Eff. Alkali % | Sulfidity % | Max. temp. °C. | Time to temp. Min. | Time at temp. Min. | Kappa No. | Total Yield % | Viscosity cps | Rejects % | True* Yield % |
|---|---|---|---|---|---|---|---|---|---|---|---|---|---|---|
| 1 | Soda | ANTHRAQUINONE | 0.25 | SBP | 18.6 | — | 180 | 60 | 48 | 30.2 | 48.7 | 14.8 | 1.15 | 48.1 |
| 2 | Soda | 2-METHYLANTHRAQUINONE | 0.25 | B.S. | 15.5 | — | 170 | 90 | 85 | 34.2 | 51.2 | 23.9 | 0.30 | 51.1 |
| 3 | Kraft | — | — | B.S. | 14.0 | 25 | 170 | 90 | 92 | 31.0 | 49.2 | 36.1 | 0.32 | 49.0 |

TABLE IV-continued

EFFECT OF ADDITIVES ON THE BLEACHING AND STRENGTH PROPERTIES OF ALKALINE PULPS - PULPING DATA

| Run No. | Pulp Type | Additive | % on wood | Wood species | Eff. Alkali % | Sulfidity % | Max. temp. °C. | Time to temp. Min. | Time at temp. Min. | Kappa No. | Total Yield % | Viscosity cps | Rejects % | True* Yield % |
|---|---|---|---|---|---|---|---|---|---|---|---|---|---|---|
| 4 | Kraft | 2-METHYLANTHRAQUINONE | 0.25 | B.S. | 13.0 | 25 | 170 | 90 | 80 | 31.1 | 51.7 | 44.9 | 0.28 | 51.6 |
| 5 | Kraft | — | — | SBP | 15.5 | 25 | 170 | 60 | 110 | 28.5 | 47.0 | 28.3 | 0.33 | 46.8 |
| 6 | Kraft | ANTHRAQUINONE | 0.25 | SBP | 15.0 | 25 | 170 | 60 | 90 | 29.4 | 50.6 | 32.4 | 0.49 | 50.4 |
| 7 | Polysulfide | — | — | B.S. | 15.0 | 25 | 170 | 90 | 95 | 25.6 | 51.3 | 40.1 | 0.58 | 51.0 |
| 8 | Polysulfide | 2-METHYLANTHRAQUINONE | 0.25 | B.S. | 15.0 | 25 | 170 | 90 | 100 | 18.9 | 50.1 | 26.4 | 0.37 | 49.9 |
| 9 | Polysulfide | ANTHRAQUINONE | 0.25 | B.S. | 15.0 | 25 | 170 | 90 | 100 | 15.8 | 50.5 | 24.9 | 0.29 | 50.4 |

*True yield includes screened yield plus 50% of rejects
Wood species:
S.B.P. = Spruce, Balsam, Pine
B.S. = Black Spruce

TABLE V

EFFECT OF ADDITIVES ON THE BLEACHING AND STRENGTH PROPERTIES OF ALKALINE PULPS - BLEACHING DATA

| Run No. | C $Cl_2$ % In. | C $Cl_2$ % Res. | E NAOH % | E NAOH pH | D $ClO_2$ % | E NaOH % | E NaOH pH | D $ClO_2$ % In. | D $ClO_2$ % Res. | Elrepho Brightness In. | Elrepho Brightness Rev. | TAPPI Viscosity cps | Yield % on Pulp | Yield % on Wood |
|---|---|---|---|---|---|---|---|---|---|---|---|---|---|---|
| 1 | 6.6 | 1.2 | 4.0 | 11.3 | 1.5 | 0.6 | 10.8 | 0.3 | 0.10 | 87.7 | 85.2 | 11.3 | 96.4 | 46.4 |
| 2 | 7.5 | 1.2 | 4.5 | 11.3 | 1.7 | 0.8 | 10.9 | 0.3 | 0.15 | 87.2 | 84.5 | 15.3 | 91.9 | 48.0 |
| 3 | 6.8 | 0.8 | 4.1 | 11.4 | 1.4 | 0.7 | 11.4 | 0.3 | 0.13 | 86.5 | 84.2 | 22.7 | 92.0 | 45.1 |
| 4 | 6.8 | 1.1 | 4.1 | 11.4 | 1.40 | 0.8 | 11.0 | 0.3 | 0.17 | 87.3 | 84.8 | 25.0 | 94.7 | 48.9 |
| 5 | 6.3 | 1.1 | 3.8 | 11.4 | 1.35 | 0.6 | 10.9 | 0.3 | 0.10 | 88.1 | 85.9 | 18.0 | 95.2 | 44.6 |
| 6 | 6.5 | 1.2 | 3.9 | 11.4 | 1.38 | 0.6 | 10.9 | 0.3 | 0.15 | 89.0 | 86.7 | 21.2 | 94.4 | 47.6 |
| 7 | 5.6 | 0.7 | 3.4 | 11.7 | 1.14 | 0.7 | 11.3 | 0.3 | 0.13 | 86.3 | 84.2 | 25.6 | 94.0 | 47.9 |
| 8 | 4.2 | 0.6 | 2.5 | 11.4 | 1.1 | 0.7 | 11.3 | 0.3 | 0.13 | 85.2 | 83.1 | 18.8 | 95.9 | 47.9 |
| 9 | 3.5 | 0.5 | 2.1 | 11.4 | 1.1 | 0.7 | 11.2 | 0.3 | 0.17 | 85.8 | 84.2 | 16.7 | 96.7 | 48.8 |

TABLE VI

EFFECT OF ADDITIVES ON THE BLEACHING AND STRENGTH PROPERTIES OF ALKALINE PULPS - STRENGTH DATA

| Run No. | Breaking Length km 300 CSF | Breaking Length km 500 CSF | Burst Factor 300 CSF | Burst Factor 500 CSF | Tear Factor 300 CSF | Tear Factor 500 CSF | Bulk 300 CSF | Bulk 500 CSF | Elongation 300 CSF | Elongation 500 CSF | Revolutions PFI Mill X $10^{-3}$ 300 CSF | Revolutions PFI Mill X $10^{-3}$ 500 CSF |
|---|---|---|---|---|---|---|---|---|---|---|---|---|
| 1 | 12.4 | 11.8 | 97 | 96 | 86 | 97 | 1.30 | 1.40 | 2.6 | 2.7 | 6.8 | 3.1 |
| 2 | 11.8 | 11.0 | 96.5 | 93.9 | 78 | 83 | 1.27 | 1.38 | 2.8 | 3.1 | 10.8 | 4.5 |
| 3 | 11.7 | 11.8 | 104.1 | 105.0 | 93 | 103 | 1.28 | 1.30 | 3.3 | 3.3 | 12.0 | 6.4 |
| 4 | 13.2 | 12.3 | 109.5 | 107.4 | 84 | 90 | 1.28 | 1.30 | 3.3 | 3.9 | 10.5 | 4.9 |
| 5 | 12.3 | 11.8 | 106 | 101 | 90 | 101 | 1.25 | 1.30 | 2.6 | 3.0 | 8.8 | 4.5 |
| 6 | 12.4 | 11.7 | 107 | 103 | 87 | 103 | 1.25 | 1.35 | 2.9 | 3.0 | 7.1 | 3.3 |
| 7 | 12.4 | 11.2 | 106.0 | 97.5 | 80 | 96 | 1.32 | 1.30 | 3.6 | 3.4 | 10.5 | 4.9 |
| 8 | 12.0 | 11.5 | 100.8 | 95.5 | 80 | 88 | 1.26 | 1.32 | 2.9 | 3.1 | 9.8 | 4.8 |
| 9 | 11.8 | 12.0 | 95.2 | 95.1 | 72 | 77 | 1.27 | 1.20 | 2.9 | 3.0 | 10.4 | 5.6 |

EXAMPLE 5

15 samples of chips from the wood species B.A. (a mixture of birch and aspen) or S.B.P. (a mixture of spruce, balsam and pine) were subjected to pulping treatment using the same digester and procedure as in Example 1. In runs 1, 6, 7, 12 and 13 the pulping liquor was a kraft liquor while in runs 2 to 5 and 8 to 11, it was a soda liquor and in runs 14 and 15, it was a polysulphide liquor with 2% added sulphur. 9, 10 anthraquinone was used as the additive according to the invention in the pulping liquors of runs 3 to 5, 7, 8, 10, 11, 13 and 15 but no additive was used in those of runs 1, 2, 6, 9, 12 and 14. The characteristics of the 15 pulping runs are shown in Table VII.

Runs 2, 4, 5 and 9 to 15 were then subjected to alkaline oxygen treatment. In this treatment, the pulp at a consistency of 35% by weight was treated with sodium hydroxide. Then at a consistency of 26% by weight the alkaline pulp was treated in a pressure vessel with oxygen at a pressure of 90 pounds per square inch. In all these runs, $Mg^{++}$ was added to the sodium hydroxide in the amount of 0.2% on pulp.

The details of the treatment are set out in Table VII.

The oxygen treated runs and runs 1, 3 and 6 to 8 were finally subjected to a conventional bleaching sequence C-E-D-E-D. The details of the bleaching are given in Table VIII. It should be noted that the % yield on wood as shown in this Table allows credit for one half of pulping rejects.

The strength properties of the fully bleached pulp of runs 6 to 15 are shown in Table IX. The same properties of the pulps of runs 1 to 5 could not be determined because of a shortage of the wood species B.A. (birch-aspen mixture).

All softwood pulps above kappa No. 3 and all hardwood pulps above kappa No. 20 were refined prior to measurement of kappa No. and further treatment. Other pulps were screened to remove rejects. Refining was done in two passes through a laboratory Sprout-Waldron refiner first at 0.020 inch clearance and then at 0.005 inch clearance.

TABLE VII

SODA-OXYGEN AND KRAFT-OXYGEN PULPING WITH ADDITIVES IN THE FIRST STAGE PULPING AND OXYGEN STAGE DATA

| | | PULPING DATA | | | | | | | | | OXYGEN STAGE | | | | | |
|---|---|---|---|---|---|---|---|---|---|---|---|---|---|---|---|---|
| Run No. | Pulp type | % Additive on wood | Wood species | Eff. Alkali % | Sulfidity % | Max. temp. °C. | Time to temp. min. | Time at temp. min. | Pulp Kappa No. | Pulp Yield % on wood | NaOH, % on pulp | Temp. °C. | Time min. | Kappa No. | Yield % on pulp | TAPPI Viscosity cps |
| 1 | Kraft | — | B.A. | 12.0 | 25 | 170 | 60 | 120 | 18.8 | 53.2 | — | — | — | — | — | — |
| 2 | Soda-Oxygen | — | B.A. | 12.4 | 0 | 180 | 60 | 60 | 39.6 | 56.2 | 3.6 | 120 | 30 | 18.1 | 95.0 | 21.2 |
| 3 | Soda-Additive | 0.25 | B.A. | 15.5 | 0 | 170 | 60 | 60 | 20.0 | 54.7 | — | — | — | — | — | — |
| 4 | Soda-Additive-Oxygen | 0.25 | B.A. | 12.5 | 0 | 180 | 60 | 20 | 43.6 | 58.6 | 3.5 | 120 | 30 | 14.0 | 94.1 | 24.8 |
| 5 | Soda-Additive-Oxygen | 1.00 | B.A. | 9.3 | 0 | 170 | 120 | 40 | 92.3 | 70.1 | 6.5 | 120 | 40 | 32.2 | 87.1 | 21.9 |
| 6 | Kraft | — | SBP | 15.5 | 25 | 170 | 60 | 110 | 28.5 | 47.0 | — | — | — | — | — | — |
| 7 | Kraft-Additive | 0.25 | SBP | 15.0 | 25 | 170 | 60 | 90 | 29.4 | 50.6 | — | — | — | — | — | — |
| 8 | Soda-Additive | 0.25 | SBP | 18.6 | 0 | 180 | 60 | 48 | 30.2 | 48.7 | — | — | — | — | — | — |
| 9 | Soda-Oxygen | — | SBP | 15.5 | 0 | 180 | 60 | 50 | 109.4 | 55.0 | 9.9 | 120 | 40 | 25.0 | 85.7 | 6.7 |
| 10 | Soda-Additive-Oxygen | 0.25 | SBP | 11.6 | 0 | 180 | 60 | 30 | 105.4 | 61.0 | 8.4 | 120 | 40 | 32.4 | 86.3 | 10.4 |
| 11 | Soda-Additive-Oxygen | 1.00 | SBP | 10.8 | 0 | 180 | 60 | 28 | 94.6 | 61.4 | 7.6 | 120 | 40 | 29.0 | 88.8 | 13.6 |
| 12 | Kraft-Oxygen | — | SBP | 12.0 | 25 | 170 | 60 | 30 | 109.9 | 59.2 | 9.4 | 120 | 40 | 31.1 | 84.3 | 11.2 |
| 13 | Kraft-Additive-Oxygen | 0.13 | SBP | 10.0 | 25 | 170 | 60 | 75 | 104.5 | 61.3 | 9.9 | 120 | 40 | 31.4 | 85.6 | 12.3 |
| 14 | Polysulphide-Oxygen | — | SBP | 12.0 | 25 | 170 | 60 | 60 | 96.4 | 60.6 | 7.7 | 120 | 40 | 28.0 | 85.2 | 16.7 |
| 15 | Polysulphide-Additive-Oxygen | 0.13 | SBP | 11.0 | 25 | 170 | 60 | 70 | 96.0 | 63.6 | 7.7 | 120 | 40 | 27.1 | 85.0 | 17.0 |

Wood Species:
S.B.P. = Spruce, Balsam, Pine
B. A. = Birch, Aspen

TABLE VIII

BLEACHING DATA ON PULPS FROM TABLE VII

| Run | C $Cl_2$ % | | E NaOH | | D $ClO_2$ | E NaOH | | D $ClO_2$ % | | Elrepho Brightness | | TAPPI Viscosity | Yield | |
|---|---|---|---|---|---|---|---|---|---|---|---|---|---|---|
| No. | In. | Res. | % | pH | % | % | pH | In. | Res. | In. | Rev. | cps | % on Pulp | % on Wood |
| 1 | 3.4 | 0.1 | 2.1 | 10.9 | 0.7 | 0.5 | 10.5 | 0.4 | 0.3 | 88.0 | 85.1 | 30.0 | 94.1 | 49.3 |
| 2 | 3.6 | 0.2 | 2.2 | 10.8 | 0.4 | 0.6 | 11.0 | 0.4 | 0.2 | 88.6 | 85.9 | 17.0 | 95.3 | 50.9 |
| 3 | 4.4 | 0.9 | 2.9 | 11.5 | 0.8 | 0.5 | 11.0 | 0.4 | 0.2 | 87.9 | 85.5 | 19.2 | 95.1 | 51.8 |
| 4 | 2.8 | 0.2 | 1.5 | 10.0 | 0.5 | 0.5 | 10.5 | 0.3 | 0.2 | 88.2 | 85.2 | 22.1 | 96.0 | 53.0 |
| 5 | 7.1 | 0.3 | 4.3 | 10.8 | 0.6 | 0.7 | 11.0 | 0.4 | 0.2 | 85.7 | 83.3 | 18.8 | 91.2 | 55.7 |
| 6 | 6.3 | 1.1 | 3.8 | 11.4 | 1.4 | 0.6 | 10.9 | 0.3 | 0.1 | 88.1 | 85.9 | 18.0 | 95.2 | 44.6 |
| 7 | 6.5 | 1.2 | 3.9 | 11.4 | 1.4 | 0.6 | 10.9 | 0.3 | 0.1 | 89.0 | 86.7 | 21.2 | 94.4 | 47.8 |
| 8 | 6.6 | 1.2 | 4.0 | 11.3 | 1.5 | 0.6 | 10.8 | 0.3 | 0.1 | 87.7 | 85.2 | 11.3 | 96.4 | 46.4 |
| 9 | 5.5 | 0. | 3.3 | 11.1 | 1.1 | 0.6 | 10.8 | 0.3 | 0.1 | 90.4 | 88.7 | 6.7 | 92.9 | 43.8 |
| 10 | 7.1 | 0.2 | 4.3 | 10.9 | 1.1 | 0.6 | 10.8 | 0.3 | 0.1 | 86.6 | 87.5 | 10.9 | 91.2 | 48.0 |
| 11 | 7.0 | 0.1 | 3.8 | 10.9 | 1.2 | 0.6 | 10.9 | 0.3 | 0.1 | 86.7 | 84.9 | 13.5 | 90.8 | 49.5 |
| 12 | 6.8 | 0.1 | 4.1 | 11.4 | 1.0 | 0.6 | 11.0 | 0.3 | 0.1 | 90.6 | 89.0 | 11.2 | 92.7 | 46.3 |
| 13 | 6.9 | 0.1 | 4.1 | 11.3 | 1.1 | 0.6 | 10.7 | 0.3 | 0.1 | 89.5 | 87.8 | 12.9 | 92.7 | 48.6 |
| 14 | 6.2 | 0.2 | 3.7 | 11.5 | 1.0 | 0.6 | 10.8 | 0.3 | 0.2 | 91.2 | 89.7 | 15.9 | 93.4 | 48.2 |
| 15 | 6.0 | 0.1 | 3.6 | 11.2 | 1.0 | 0.6 | 10.8 | 0.3 | 0.2 | 90.1 | 88.5 | 16.9 | 93.6 | 50.6 |

TABLE IX

STRENGTH DATA ON BLEACHED PULPS FROM TABLE VIII

| Run No. | Breaking Length km 300 CSF | Breaking Length km 500 CSF | Burst Factor 300 CSF | Burst Factor 500 CSF | Tear Factor 300 CSF | Tear Factor 500 CSF | Bulk 300 CSF | Bulk 500 CSF | Elongation 300 CSF | Elongation 500 CSF | Revolutions PFI Mill × $10^{-3}$ 300 CSF | Revolutions PFI Mill × $10^{-3}$ 500 CSF |
|---|---|---|---|---|---|---|---|---|---|---|---|---|
| 6 | 12.3 | 11.8 | 106 | 101 | 90 | 101 | 1.2 | 1.3 | 2.6 | 3.0 | 8.8 | 4.5 |
| 7 | 12.4 | 11.7 | 107 | 103 | 87 | 103 | 1.2 | 1.3 | 2.9 | 3.0 | 7.1 | 3.3 |
| 8 | 12.4 | 11.8 | 97 | 96 | 86 | 97 | 1.3 | 1.4 | 2.6 | 2.7 | 6.8 | 3.1 |
| 9 | 9.8 | 8.4 | 71 | 60 | 61 | 77 | 1.2 | 1.2 | 2.2 | 2.4 | 4.3 | 2.2 |
| 10 | 10.8 | 10.1 | 91 | 78 | 63 | 88 | 1.2 | 1.2 | 2.6 | 2.8 | 4.1 | 1.6 |
| 11 | 11.8 | 10.4 | 91 | 81 | 64 | 90 | 1.2 | 1.3 | 2.7 | 2.8 | 4.0 | 1.6 |
| 12 | 11.5 | 10.0 | 90 | 81 | 70 | 81 | 1.2 | 1.3 | 2.6 | 2.8 | 5.4 | 2.6 |
| 13 | 12.0 | 10.6 | 97 | 87 | 67 | 82 | 1.2 | 1.2 | 3.0 | 2.5 | 6.1 | 2.7 |
| 14 | 12.3 | 11.3 | 104 | 91 | 79 | 92 | 1.2 | 1.3 | 2.8 | 2.8 | 5.3 | 2.1 |
| 15 | 12.3 | 10.7 | 103 | 93 | 73 | 94 | 1.2 | 1.2 | 2.8 | 3.0 | 4.8 | 1.9 |

I claim:

1. A process for the delignification of lignocellulosic material comprising the steps of 1. treating the lignocellulosic material in a closed reaction vessel with an alkaline pulping liquor containing from 0.001% to 10.0% by weight based on the lignocellulosic material, of a cyclic keto compound selected from the group consisting of naphthoquinone, anthraquinone, anthrone, phenanthrenequinone, the alkyl, alkoxy and amino derivatives of said quinones, 6,11-dioxo-1H-anthra-[1,2-c]pyrazole, anthraquinone-1,2-naphthacridone, 7,12-dioxo-7,12-dihydroanthra[1,2-b]pyrazine 1,2-benzanthraquinone and 10-methylene anthrone, the treatment taking place at a maximum temperature in the range of from 150° C. to 200° C. for a period of 0.5 to 480 minutes, and
2. displacing the pulping liquor from the lignocellulosic material with water or an aqueous liquor inert to the lignocellulosic material to obtain a delignified cellulosic material.

2. A process as claimed in claim 1 wherein the alkyl quinone derivatives are quinones substituted with one or two alkyl groups each having 1 to 4 carbon atoms and the alkoxy quinone derivatives are quinone substituted with at least one alkoxy group containing 1 to 4 carbon atoms.

3. A process as claimed in claim 1 wherein the quinone is anthraquinone.

4. A process as claimed in claim 1 wherein the cyclic keto compounds are selected from the group consisting of anthrone, anthraquinone, 2-methylanthraquinone, 2-ethylanthraquinone, 2,6-dimethylanthraquinone, 2,7-dimethylanthraquinone, 2-amino anthraquinone and 1-methoxyanthraquinone.

5. A process as claimed in claim 1 wherein the alkaline pulping liquor contains from 0.01% to 1.0% by weight based on lignocellulosic material, of the cyclic keto compound.

6. A process as claimed in claim 1 wherein the alkaline pulping liquor is a soda liquor.

7. A process as claimed in claim 1 wherein the alkaline pulping liquor is a kraft liquor.

8. A process as claimed in claim 7 wherein the kraft liquor contains from 1.0% to 5.0% by weight (based on weight of lignocellulosic material) of polysulphides expressed as sulphur.

9. A process as claimed in claim 1 wherein the delignified cellulosic material is subjected to the following additional steps:

3. treatment of the delignified cellulosic material in aqueous suspension at a consistency of from 2% to 40% by weight for from 0.5 to 60 minutes at from 20° C. to 90° C. with from 2% to 20% by weight of an alkali metal base and
4. treatment of the alkali treated material in an aqueous medium at a consistency of from 3.0% to 40% by weight with oxygen or an oxygen-containing gas for from 0.5 to 120 minutes at a temperature of from 80° C. to 150° C. and a partial pressure of oxygen of from 20 to 200 pounds per square inch.

10. A process as claimed in claim 1 wherein the delignified cellulosic material is subjected to conventional bleaching.

11. A process as claimed in claim 9 wherein the oxygen-treated cellulosic material is subjected to conventional bleaching.

* * * * *